United States Patent [19]

Skoglund et al.

[11] 4,066,013

[45] Jan. 3, 1978

[54] MECHANICAL SAFETY DEVICE FOR THE PLUNGER IN PRESSES OF THE DOWN-STROKE OR ECCENTRIC TYPE

[75] Inventors: Klas Axel Lennart Skoglund; Stig Gunnar Bengt Backgård, both of Lagan, Sweden

[73] Assignee: Lagan Press AB, Lagan, Sweden

[21] Appl. No.: 709,789

[22] Filed: July 29, 1976

[51] Int. Cl.[2] ..... B30B 15/00

[52] U.S. Cl. ..... 100/53; 83/DIG. 1; 192/129 R

[58] Field of Search ..... 83/DIG. 1, 523; 100/53; 72/441, 446; 74/612–616; 192/129 R, 134; 248/325, 354 S

[56] References Cited

U.S. PATENT DOCUMENTS

| | | | |
|---|---|---|---|
| 2,240,630 | 5/1941 | Stacy | 100/53 |
| 2,653,560 | 9/1953 | Bradhering | 100/53 |
| 2,946,277 | 7/1960 | Archer | 100/53 |
| 3,095,804 | 7/1963 | Linder | 100/53 |

FOREIGN PATENT DOCUMENTS

| | | | |
|---|---|---|---|
| 10,156 | 3/1972 | Japan | 100/53 |

*Primary Examiner*—Billy J. Wilhite
*Attorney, Agent, or Firm*—Brumbaugh, Graves, Donohue & Raymond

[57] ABSTRACT

A mechanical safety device for the reciprocating plunger in downwardly acting presses such as a down-stroke or eccentric type, in which the plunger is connected to the piston rod of the press cylinder or to the eccentric. A stopping rod is immovably fixed on the plunger and extends vertically upwardly from the plunger and through a stopping sleeve rotatably mounted on a housing fixedly retained on the press. The rod and the sleeve have cooperating threads, the threads on the rod being divided into at least two sections and the threads on the sleeve being divided into as many sections as the threads on the rod and being spaced by arcuate surfaces. In a first rotary position of the sleeve, the threads engage with each other for stopping the plunger, and in a second rotary position of the sleeve, the threads are moved out of engagement with each other for permitting movement of the rod through the sleeve and thereby movement of the plunger.

10 Claims, 6 Drawing Figures

MECHANICAL SAFETY DEVICE FOR THE PLUNGER IN PRESSES OF THE DOWN-STROKE OR ECCENTRIC TYPE

The present invention relates to a mechanical safety device for the plunger in presses with overhead, vertical press cylinders; presses of the so-called down-stroke type, or eccentric presses, hereinafter generally referred to as downardly acting presses, the plunger being connected to the piston rod of the press cylinder or to the eccentric.

Presses of this type tend to become larger and heavier and consequently also to some extent more dangerous to work with. Various safety devices are prescribed for reducing, as far as is possible, the risk of personal injury during the press operation itself. However, one or more of these devices must be put out of operation for the purposes of carrying out repair or adjustment work within the press, for example, tool change. The Authorities concerned have now become aware of this situation and have, therefore, issued instructions which entail that, in presses where there is a risk of personal injury if the plunger slowly drops in, for example, line leakage, there shall be provided a mechanical safety device for the plunger, which device is to be used when the reparatory or adjustment work is carried out within the press and in the event of longer down-time.

A major aspect of the present invention is to provide a mechanical safety device which satisfies the requirements of the Authorities and is simple and reliable in construction and function.

According to this major aspect of the invention, a stopping rod is immovably fixed on the plunger, the rod extending vertically upwardly from the plunger and through a stopping sleeve rotatably mounted on a fixed portion of the press. Moreover, the rod and the sleeve have cooperating members which, in a first rotary position of the sleeve, engage with each other for stopping the plunger; and, in a second rotary position of the sleeve, are moved out of engagement with each other to permit movement of the rod through the sleeve and thereby movement of the plunger.

The nature of the invention and its aspects will be more fully understood from the following description of the drawings, which show a preferred embodiment of the present invention by way of example, and discussion relating thereto.

Figure 1:
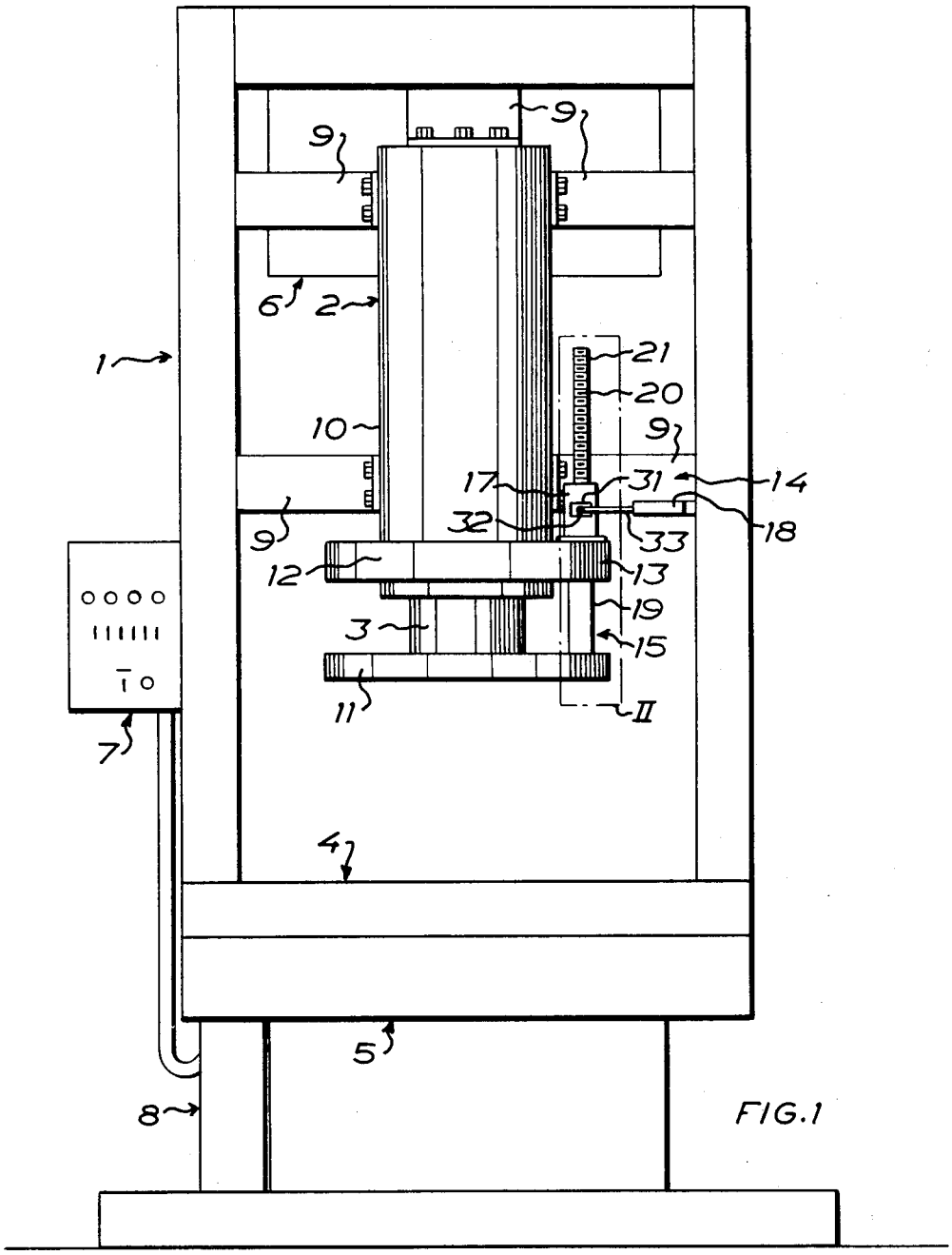
FIG. 1 is a highly schematic front elevation of a hydraulic press with a safety device according to the invention mounted thereon.
Figure 2:
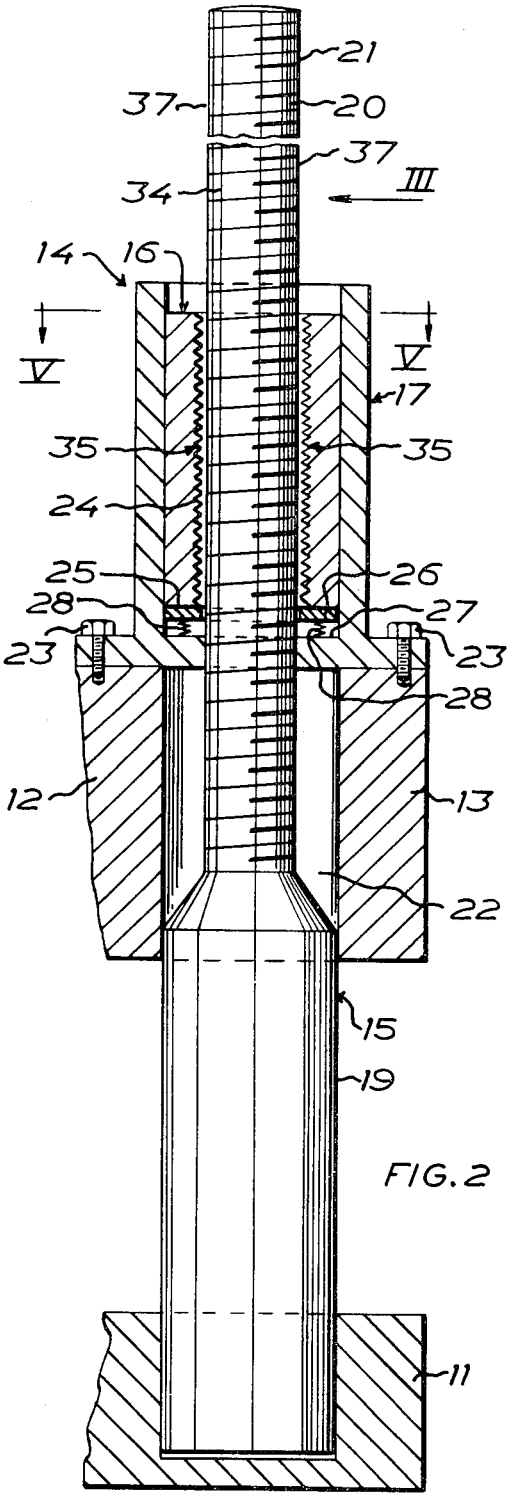
FIG. 2 shows a section of the region within the dash-dot line II in FIG. 1.
Figure 4:
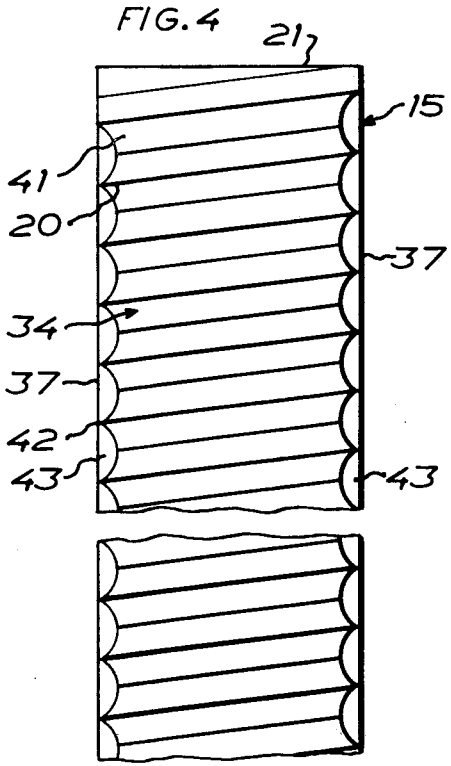
FIGS. 3 and 4 are projections in the direction of the arrows III and IV in FIGS. 2 and 3, respectively.
Figure 3:
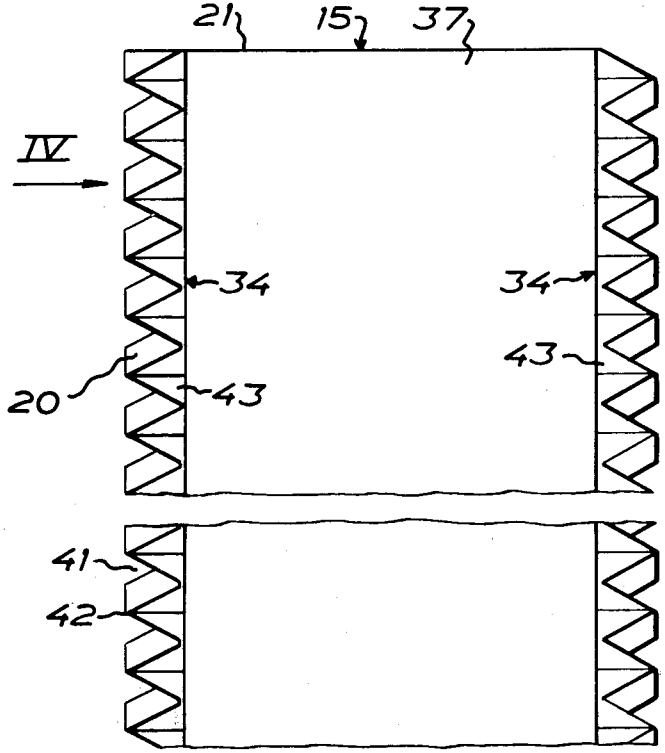
Figure 5:
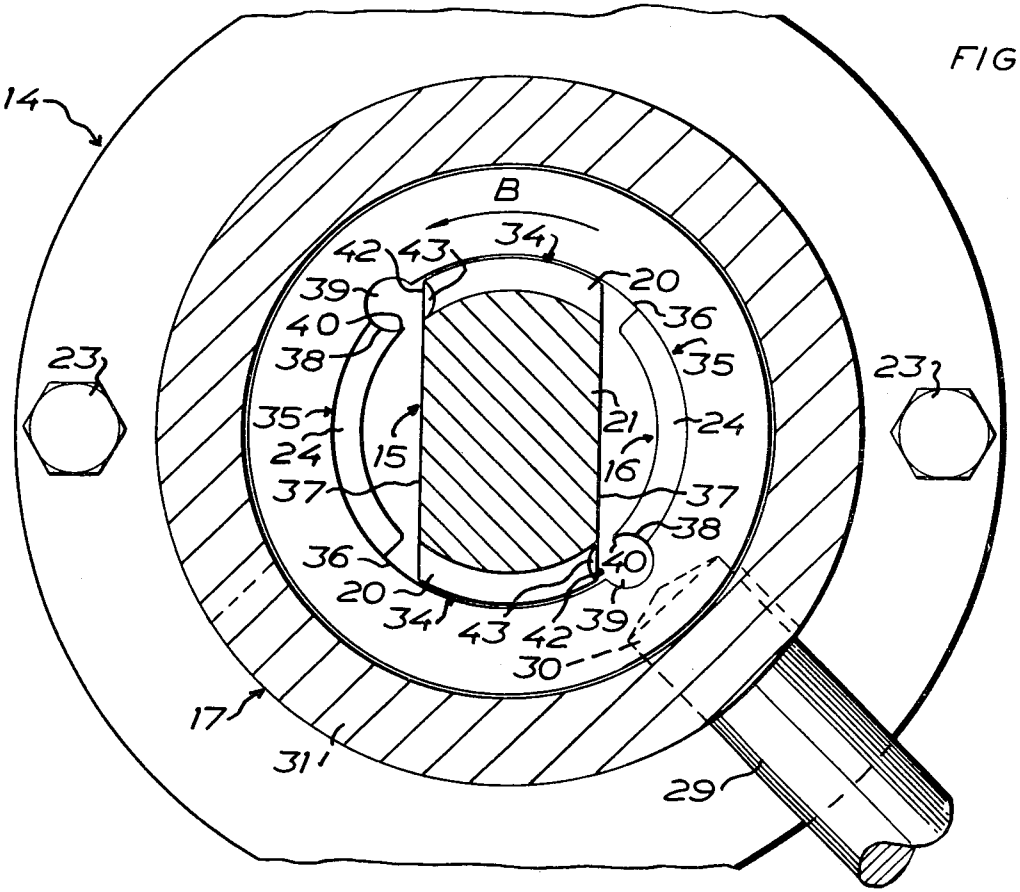
FIG. 5 shows, on a larger scale, a section taken along the line V—V in FIG. 2 and illustrates a stopping sleeve included in the safety device, in one rotary position.
Figure 6:
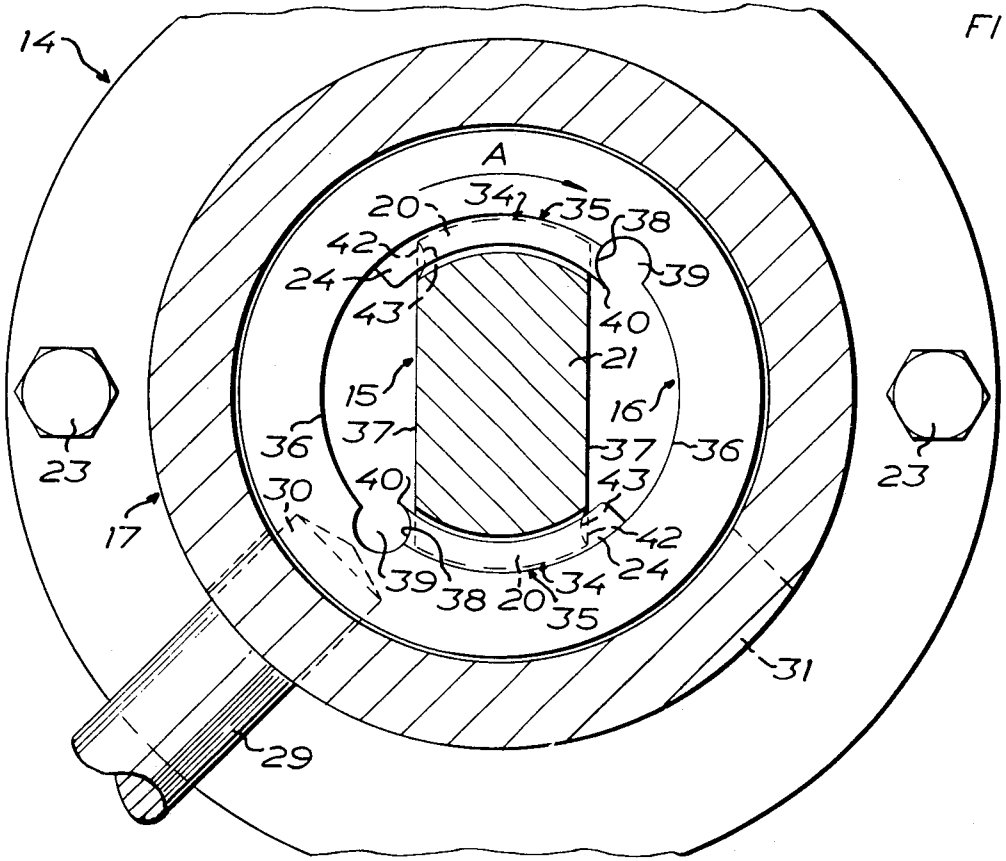
FIG. 6 shows a section, corresponding to FIG. 5 with the stopping sleeve in another rotary position.

The hydraulic press shown in FIG. 1 has a frame 1 of top-quality solid steel, a press cylinder 2 with a hardened and chromium-plated piston rod 3, a press table 4, a die-table 5 mounted on a steel plate (not shown) which is fixedly attached to the piston rod of a die-cylinder (not shown), a pump unit 6 consisting of a motor, a pump, a tank and a regulating valve, regulating equipment 7 for controlling and operating the press, and electrical equipment 8 for current supply. For the purposes of clarity, no tools associated with the press have been shown.

As will be appreciated from the drawings, the press cylinder 2 is vertically arranged and is either fixedly or movably mounted on the frame 1 by means of brackets 9. The piston rod 3 has, at its lower end projecting from the cylinder tube 10, a plunger 11 for accommodating a press tool, for example, a punch. The plunger 11 is in the form of a circular disc of substantially greater diameter than that of the piston rod 3. Facing the plunger 11, there is provided an end wall 12 closing the piston rod side-end of the press cylinder 2 and having a flange 13.

The press is provided with a mechanical safety device, generally designated 14, for stopping the plunger 11 in any optional position within the stroke of the press during, for example, reparatory or adjustment work within the press, for example, tool change. The main reason why it is desirable to be able to stop the plunger at any given point within the stroke of the press is that it is not always possible or advisable to move the plunger 11 to one end position or the other.

The major parts of the safety device 14 are a stopping rod 15, a stopping sleeve 16, a housing 17 and a power cylinder, which is shown in FIG. 1 as a hydraulic cylinder 18, however a pneumatic cylinder or other similar reciprocable device is suitable.

The stopping rod 15 is of steel of a suitable quality and has a shaft portion 19 of circular cross-section and a portion 21 which is threaded 20. The shaft portion 19 and thereby the rod 15 is immovably fixed on the plunger 11, for example, by means of a bolt connection, shrinkage fit or key joint and extends vertically upwardly from the plunger, aligned for a precise and accurate fit through a hole 22 provided in the flange 13 of the cylinder end wall 12, and aligned for a similarly precise and accurate fit through the stopping sleeve 16, in order to avoid unintended interference of the threads 20, 24 of the respective rod 15 and sleeve 16, as described below.

The stopping sleeve 16 is circularly cylindrical and is, like the rod 15, made of steel of a suitable quality. The sleeve is threaded 24 for cooperation (which will be described below) with the threads 20 on the rod 15. The sleeve is rotatably journaled in the housing 17 but formed to be closely fitted within the housing to retain an accurate axial alignment of the sleeve bore with the rod 15. The housing 17, like the sleeve, is of circularly cylindrical configuration and is fixed, by means of bolts 23, to the upper side of the flange 13 of the cylinder end wall 12, straight above the hole 22 in the flange. The sleeve rests (for purposes which will be described below) with its under-side 25 on an annular plate 26 which is supported against the bottom 27 of the housing 17 by means of a number of compression springs 28 which bias the plate in a direction towards the sleeve 16.

The sleeve 16 is rotatable by means of an arm 29; whose one end 30 is screwed into the sleeve 16 and extends through a slot 31 provided in the housing 17 and extending through a centre angle of about 90°; and whose other end 32 is connected to the piston rod 33 in the hydraulic cylinder 18 which, at its end located distally from the piston rod, is connected to the frame 1 or some other suitable part of the press.

In the illustrated and described embodiment, the threads 20 and 24 of the rod 15 and the sleeve 16, respectively, are divided into two sections 34 and 35, respectively, to form a type of bayonet catch so that, in a first rotary position A of the sleeve 16, they engage with each other for stopping the plunger 11, and, in a second rotary position B of the sleeve, they are moved out of engagement with each other in order to permit movement of the rod 15 through the sleeve 16 and, thereby, normal movement of the plunger 11. The threaded sections 35 of the sleeve 16 are spaced by arcuate portions 36, against which the threaded sections 34 of the rod 15 slidingly abut when these are located outside the threaded sections 35. The threaded sections 34 of the rod 15 are spaced by planar surfaces 37 which may be provided by milling of the round blank forming the rod 15.

In order, in the initial rotation of the sleeve 16 to the first rotary position A, to ensure correct engagement between the threads 20, 24 of the rod 15 and the sleeve 16 (in other words to prevent the threads in the sides of the thread sections 34, 35 facing each other from striking each other and thereby hindering thread engagement) there is provided, in the transitional region between the leading side 38 of each sleeve thread section 35 and an adjacent arcuate surface 36, a drilled recess 38 which extends throughout the entire length of the sleeve 16. As a result, the ends of the threads 24 located at the leading side 38 are shaped into points 40 which, on rotation of the sleeve 16 in a direction towards the first rotary position A, gain admission to an adjacent thread gap 41 on the associated thread section 34 on the rod 15. Moreover, the threads 20 on the rod 15 on that side 42 of the thread sections 34 which face the points 40 on the threads 24 in each sleeve thread section 35 have milled notches 43 for guiding each point 40 into an adjacent thread gap 41 on the associated rod thread section 34.

In view of the fact that the threads 20, 24 on the rod 15 and the sleeve 16 have a certain pitch, the sleeve 16 must, on its rotation, be able to move somewhat in the axial direction. The previously mentioned plate 26 biased by the compression springs 29 permits this axial movement of the sleeve.

Naturally, the invention is not restricted to use in hydraulic presses as has been described above, but may be equally well used in eccentric presses which have exactly the same risk for personal injury if the plunger were to move, for example by unintentional rotation of the eccentric. Moreover, the invention can be varied in many ways within the spirit and scope of the protection claimed. For example, the number of thread sections 34, 35 of the rod 15 and the sleeve 16 can be greater than two, and the sleeve may be rotated in a different manner than by means of the cylinder 18. The essential feature of the invention is that the plunger 11 can be stopped in a fully safe and reliable manner at any given point within the stroke of the press.

What I claim and desire to secure by Letters Patent is:

1. In a mechanical safety device for the reciprocating plunger in downwardly acting presses, the improvement comprising a stopping rod immovably fixed on the plunger and extending vertically upwardly from the plunger, a stopping sleeve rotatably mounted on a fixed portion of the press and positioned such that the rod passes therethrough, the rod and sleeve having cooperating members which, in a first rotary position of the sleeve, engage with each other for stopping the plunger, and, in a second rotary position of the sleeve, are moved out of engagement with each other to permit movement of the rod through the sleeve and thereby movement of the plunger, and means for rotating the sleeve.

2. In a mechanical safety device for the reciprocating plunger in downwardly acting presses, the improvement comprising an upwardly directed stopping rod supported by the plunger, a stopping sleeve rotatably mounted on a fixed portion of the press, the sleeve positioned so that the rod extends therethrough, the rod and sleeve have co-operating threads which, in a first rotary position of the sleeve, engage with each other for stopping the plunger, and, in a second rotary position of the sleeve are moved out of engagement with each other to permit movement of the rod through the sleeve and thereby movement of the plunger, and means for rotating the sleeve.

3. The device as recited in claim 2, wherein the threads on the sleeve are divided into as many sections as the threads on the rod and are spaced by arcuate surfaces.

4. The device as recited in claim 3, further including in the transitional region between the forward side of each sleeve thread section and an adjacent arcuate surface, a recess which extends throughout the entire length of the sleeve, as a result of which the ends of the threads located at the leading side are shaped into points which, on rotation of the sleeve in a direction towards the first rotary position, gain admission to an adjacent thread gap on the associated rod section.

5. The device as recited in claim 4, wherein the threads of the rod on that side of its thread sections which face the points on the threads in each sleeve thread section have notches for guiding each point into an adjacent thread gap on the associated rod thread section and thereby ensure correct engagement on initial rotation of the sleeve in a direction towards the first rotary position.

6. The device as recited in claim 2, wherein the stopping sleeve is rotatably mounted by means of a mounting member fixedly connected to the press, the mounting member having an aperture for receiving the rod, the aperture formed for a precise and accurate alignment with the rod, a housing mounted on the mounting member, and the sleeve rotatably journaled within the housing.

7. The device as recited in claim 6, wherein the mounting member comprises a flange on the end wall of the press cylinder at the piston rod side.

8. The device as recited in claim 6, wherein the housing is formed with a slot, and wherein the means for rotating the sleeve comprises an arm passing through the slot and connected at one end to said sleeve, and a means for reciprocating the arm so that the sleeve rotates correspondingly.

9. The device as recited in claim 8, wherein the arm is connected tangentially with the sleeve, and the means for reciprocating the arm comprises a power cylinder having a plunger attached to the free end of the arm, the plunger reciprocable longitudinally with respect to the arm.

10. The device as recited in claim 6, wherein a plate is provided between the underside of the sleeve and the bottom of the housing, the plate being resiliently biased in a direction towards the sleeve to permit movement of the sleeve in the axial direction on rotation thereof for adaptaion to the thread pitch.

* * * * *